US008993864B1

(12) United States Patent
Cramer

(10) Patent No.: US 8,993,864 B1
(45) Date of Patent: Mar. 31, 2015

(54) SUPPORT DEVICE FOR HARMONICA AND MICROPHONE

(71) Applicant: Mark A. Cramer, Fenton, MI (US)

(72) Inventor: Mark A. Cramer, Fenton, MI (US)

( * ) Notice: Subject to any disclaimer, the term of this patent is extended or adjusted under 35 U.S.C. 154(b) by 0 days.

(21) Appl. No.: 14/054,650

(22) Filed: Oct. 15, 2013

Related U.S. Application Data

(60) Provisional application No. 61/713,473, filed on Oct. 12, 2012.

(51) Int. Cl.
*G10D 7/12* (2006.01)
*G10G 5/00* (2006.01)
*G10D 9/02* (2006.01)

(52) U.S. Cl.
CPC ..... *G10G 5/005* (2013.01); *G10D 9/02* (2013.01); *G10D 7/123* (2013.01)
USPC ..... 84/379

(58) Field of Classification Search
CPC ..... G10D 7/123; G10G 5/005
See application file for complete search history.

(56) References Cited

U.S. PATENT DOCUMENTS

| | | | | | |
|---|---|---|---|---|---|
| 322,586 | A * | 7/1885 | Dawley | 84/379 |
| 343,833 | A * | 6/1886 | Morgenthaler | 84/379 |
| 397,541 | A * | 2/1889 | Gaertner | 84/379 |
| 411,374 | A * | 9/1889 | Clark | 84/379 |
| 439,415 | A * | 10/1890 | Morgenthaler | 84/379 |
| 507,318 | A * | 10/1893 | Gose | 84/379 |
| 753,713 | A * | 3/1904 | Knode | 84/379 |
| 769,509 | A * | 9/1904 | Sutter | 84/379 |
| 2,664,775 | A * | 1/1954 | Zielinski | 84/723 |
| 2,772,593 | A * | 12/1956 | Zielinski | 84/723 |
| 2,945,408 | A * | 7/1960 | Terlinde | 84/743 |
| 3,172,328 | A * | 3/1965 | Haile | 84/379 |
| 3,322,875 | A * | 5/1967 | Roll et al. | 84/733 |
| 4,091,704 | A * | 5/1978 | Moe | 84/378 |
| 4,146,757 | A * | 3/1979 | Murad | 381/364 |
| 4,212,219 | A * | 7/1980 | Hubbard | 84/723 |
| 4,397,213 | A * | 8/1983 | Hubbard | 84/453 |
| 4,434,329 | A * | 2/1984 | Nasu | 381/354 |
| 4,453,045 | A * | 6/1984 | Bruna | 381/354 |
| 4,497,234 | A * | 2/1985 | Strnad | 84/743 |
| 4,541,321 | A * | 9/1985 | Miner, Jr. | 84/379 |
| 4,837,836 | A * | 6/1989 | Barcus | 381/118 |
| 5,479,841 | A * | 1/1996 | Garrett | 84/379 |
| 5,608,177 | A * | 3/1997 | Zadworny | 84/379 |
| 5,619,001 | A * | 4/1997 | Pasin et al. | 84/379 |
| 7,091,408 | B2 * | 8/2006 | Thibodeau | 84/377 |
| 7,638,698 | B1 * | 12/2009 | Bellissimo | 84/379 |
| 7,916,886 | B1 * | 3/2011 | Bobisuthi et al. | 381/355 |
| 8,254,616 | B2 * | 8/2012 | Bobisuthi et al. | 381/355 |
| 8,362,346 | B1 * | 1/2013 | Prozinski | 84/379 |
| 8,450,588 | B2 * | 5/2013 | Applegate et al. | 84/379 |
| 8,729,373 | B2 * | 5/2014 | Quealy et al. | 84/377 |
| 8,754,313 | B2 * | 6/2014 | Applegate et al. | 84/379 |
| 2011/0168867 | A1 * | 7/2011 | Hennessey | 248/636 |

* cited by examiner

*Primary Examiner* — Robert W. Horn
(74) *Attorney, Agent, or Firm* — L.C. Begin & Associates, PLLC

(57) ABSTRACT

A device structured to support a harmonica and a microphone. The device includes a base, a microphone retainer secured to the base, and a harmonica securement mechanism secured to the base adjacent the microphone retainer.

18 Claims, 5 Drawing Sheets

SUPPORT DEVICE FOR HARMONICA AND MICROPHONE

CROSS-REFERENCE TO RELATED APPLICATIONS

This application claims the benefit of U.S. Provisional Application Ser. No. 61/713,473, filed on Oct. 12, 2012, the disclosure of which is incorporated herein by reference in its entirety.

BACKGROUND OF THE INVENTION

The present invention relates to devices for supporting microphones structured to receive sound from a harmonica.

Musicians frequently desire to play a harmonica simultaneously with another instrument (for example, a guitar). In such cases, a mechanism must be provided for holding or securing the harmonica in a desired position with respect to the musician's mouth. In addition, it is frequently necessary to position and secure a microphone adapted for receiving sounds from a harmonica at a predetermined distance from the harmonica or in contact with the harmonica. This positioning may be difficult to maintain while the harmonica is being played. Thus, a need exists for a mechanism and method for securing a harmonica and a suitable microphone in a desired position with respect to each other while the harmonica is being played.

SUMMARY OF THE INVENTION

In one aspect of the embodiments described herein, a device is provided for supporting a harmonica and a microphone. The support device includes a base, a microphone retainer secured to the base, and a harmonica securement mechanism secured to the base adjacent the microphone retainer.

In another aspect of the embodiments of the described herein, a device is provided for maintaining a desired spatial relationship between a harmonica and a microphone. The device includes a base, a microphone retainer secured to the base, and a harmonica securement mechanism secured to the base adjacent the microphone retainer.

BRIEF DESCRIPTION OF THE DRAWINGS

The accompanying drawings, which are incorporated in and constitute a part of this specification, illustrate embodiments of the invention and together with the description serve to explain principles of the invention.

DETAILED DESCRIPTION

Figure 1:
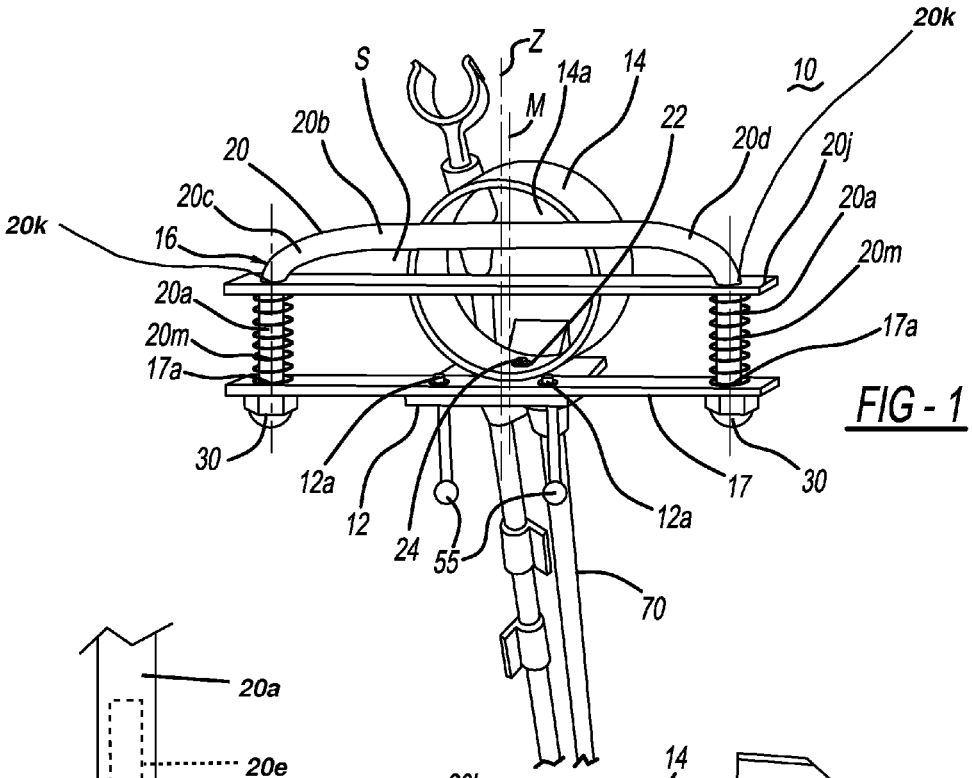
FIG. 1 is a perspective view of a device for supporting a microphone and a harmonica in accordance with an embodiment of the present invention.

FIGS. 1-7 show views of an embodiment of a device 10 for supporting a harmonica 99 and a microphone 90 configured to receive sound from the harmonica. In the embodiment shown, the support device 10 includes a base 12, a microphone retainer 14 secured to the base, and a harmonica securement mechanism 16 secured to the base in a position adjacent the microphone retainer.

Base 12 serves as a mounting structure onto which the securement mechanism 16 and the microphone retainer 14 may precisely located and mounted with respect to each other. This, in turn, enables precise positioning and securement of a microphone (mounted in the retainer) and a harmonica (mounted in the securement mechanism) with respect to each other.

In the embodiment shown, base 12 includes holes 12*a* structured to receive therethrough adjustable or removable fasteners 18 used to secure a cross-member 17 of the securement mechanism 16 to the base 12, in a manner described below. In a particular embodiment, metallic fasteners are used to secure the microphone cross-member 17 to the base 12. However, any suitable method may be used to secure the cross-member 17 to base 12, depending on the materials from which the retainer and cross-member are formed and other pertinent factors. Possible attachment methods include adhesives, ultrasonic welding, and any other suitable method.

Base 12 also includes one or more holes 22 structured to receive therethrough adjustable or removable fasteners 24 used to secure the microphone retainer 14 to the base, in a manner described below. In a particular embodiment, metallic fasteners 24 are used to secure the microphone retainer 14 to the base 12.

In one embodiment, the base is in the form of a flat plate formed from a suitable material (for example, aluminum). However, the base can have any shape or configuration suitable for the purposes described herein, and suitable for mounting on a given microphone stand or boom.

Figure 3:
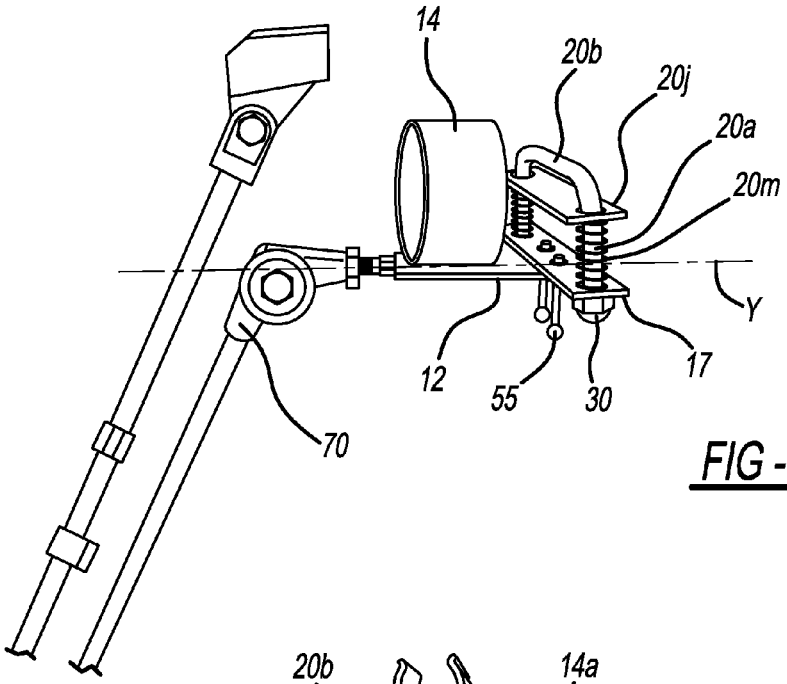
FIG. 3 is another side view of the device shown in FIG. 1.
Figure 5:
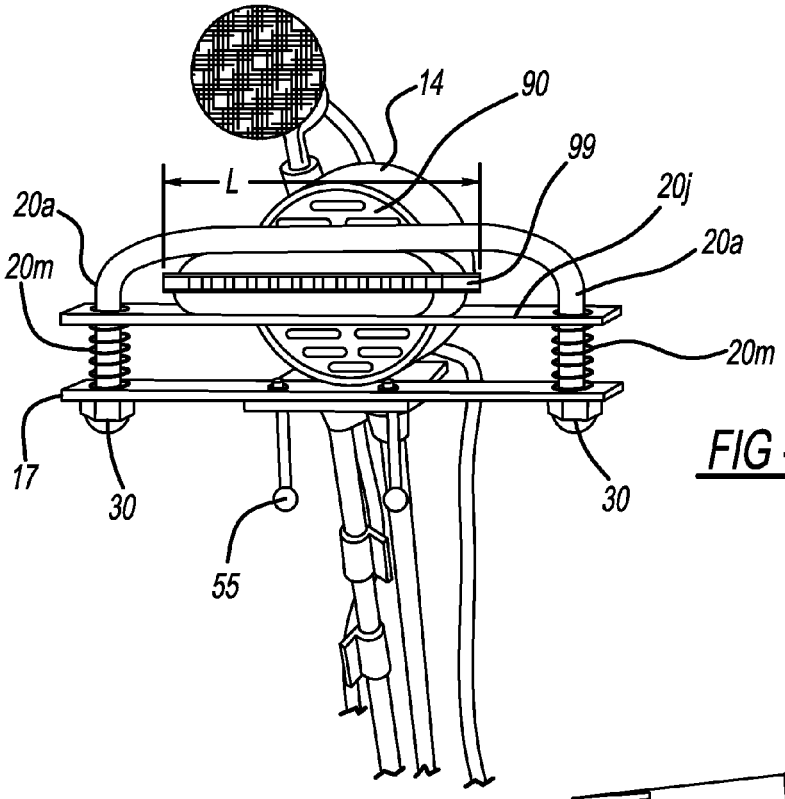
FIG. 5 is the view of FIG. 1 showing a harmonica and microphone mounted in the device.
Figure 6:
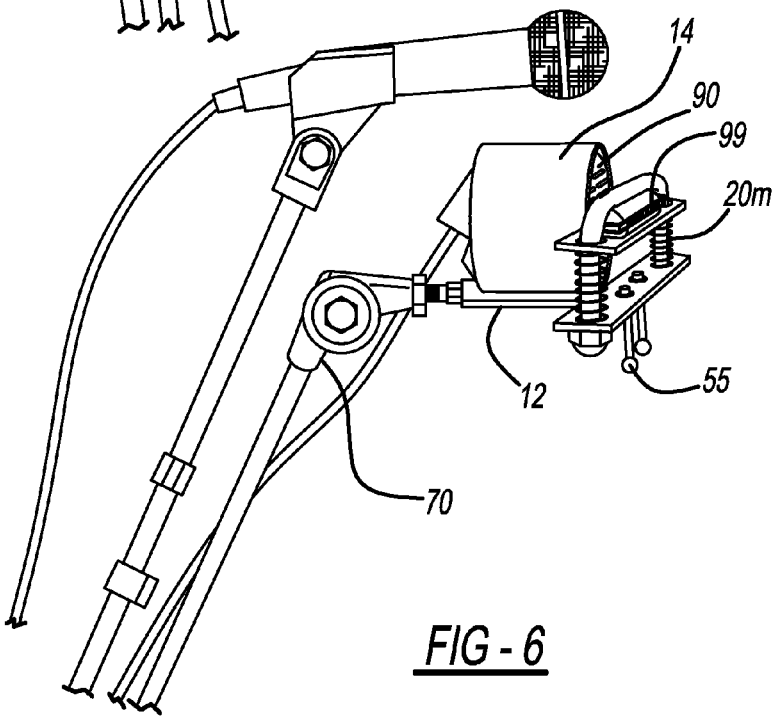
FIG. 6 is the side view of FIG. 3 showing a harmonica and microphone mounted in the device.
Figure 7:
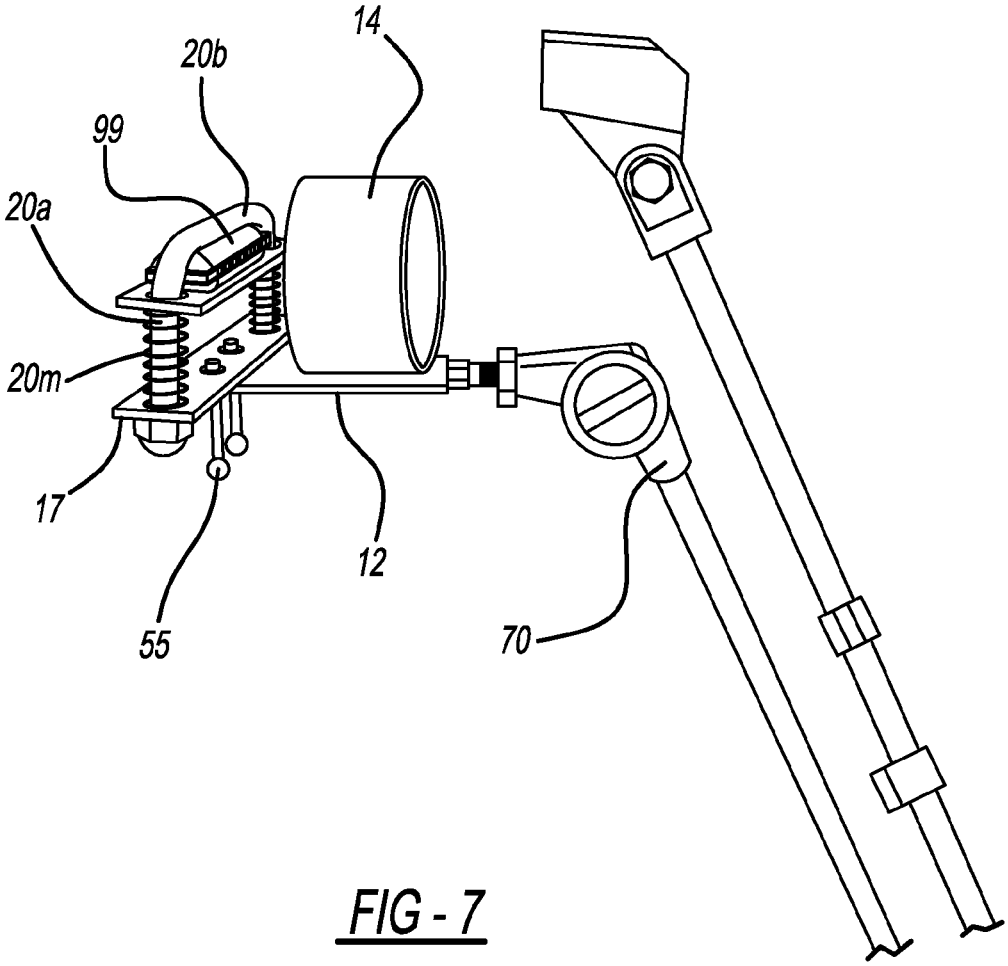
FIG. 7 is the side view of FIG. 2 showing a harmonica and microphone mounted in the device.

In a particular embodiment, holes 22 are in the form of longitudinal slots having longitudinal axes (not shown) extending parallel to an axis Y oriented perpendicular to a longitudinal extent or length dimension L of the harmonica 99 (as shown in FIGS. 3 and 5) when mounted in the securement mechanism, or perpendicular to a longitudinal extent or length dimension of cross-member 17. This permits the position of the microphone retainer 14 to be adjusted with respect to a harmonica 99 mounted in the securement mechanism 16, by simply loosening the fasteners and relocating the microphone retainer 14 to a desired position.

Any suitable method may be used to secure the retainer to base 12, depending on the materials from which the retainer and base are formed and other pertinent factors. Possible attachment methods include adhesives, ultrasonic welding, and any other suitable method.

Base 12 may be formed from aluminum, steel, plastic or any other suitable material. In a particular embodiment, the base is formed from an electrically insulative material, such as a suitable polymer. This aids in interrupting potential electrical ground paths for static charges from the device components to ground.

In the embodiment shown, securement mechanism 16 includes cross-member 17 and brace 20 secured to the cross-member. Cross-member 17 may be formed from a metallic material or any other suitable material. Cross-member 17 may be secured to base 12 using any suitable means (for example, by using metallic fasteners 55)

In one embodiment, securement mechanism brace 20 is generally "U"-shaped, having a first portion 20*b* with a first end 20*c* and a second end 20*d*, and one of arms 20*a* extending in a first direction from each of the first end 20*c* and the second end 20*d*. Arms 20*a* are spaced apart a distance sufficient to enable harmonicas of various lengths to be inserted therebetween, as shown in FIG. 5.

In one embodiment, the end of each of arms 20*a* has an exteriorly threaded portion structured to permit attachment of a suitable threaded fastener 30 thereto, for securing the arm to cross-member 17 through an associated one of base openings 17*a*. In another embodiment (shown in FIG. 1A), the end of each arm 20*a* has a threaded cavity 20*e* formed therein for receiving therein a complementarily-threaded portion of a suitable fastener, for securing the arm to cross-member 17.

In another embodiment, the holes 17*a* in cross-member 17 are structured to receive therethrough portions of arms 20*a* of brace 20. The arms 20*a* may form an interference fit with edges of the holes to secure the brace 20 to the cross-member. Alternatively, the arms 20*a* may be soldered, staked, or otherwise suitably secured to the cross-member so as to securely attach the brace 20 to the cross-member and maintain the brace firmly in position on the cross-member so as to permit manipulation by a user without loosening or detaching the brace from the cross-member or the securement mechanism from the base.

Figure 8:
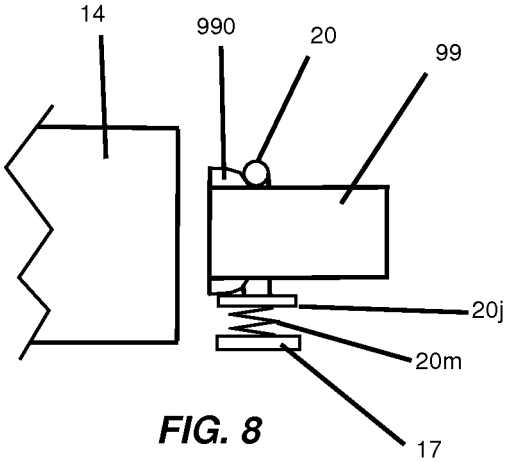
FIG. 8 is a schematic side view of a particular embodiment of the present invention.

FIG. 8 is a schematic side view of a particular embodiment in which a harmonica secured in the securement mechanism 16 may be biased against brace 20 along a shoulder 990 formed in most harmonicas. This aids in retaining the harmonica in a desired position.

A biasing member 20*j* has a pair of openings 20*k* spaced apart a distance corresponding to the spacing of the arms 20*a* and is slidingly mounted on the arms. A spring member 20*m* (in the embodiment shown, a coil spring member) is positioned along each of arms 20*a* so as to reside between the biasing member 20*j* and cross-member 17 when the brace 20 is secured to the cross-member. Spring members 20*m* are configured to be in compression when the biasing member 20*j* is spaced apart a maximum distance from cross-member 17, so as to consistently bias the biasing member in a direction away from the cross-member. In this embodiment, the biasing member 20*j* is forced toward the cross-member 17 (thereby compressing the springs 20*m*) to permit insertion and securement of the harmonica between the cross-member and biasing member.

Spring members 20*m* are structured so as to, when deflected, exert sufficient force on biasing member 20*j* to firmly retain the harmonica between the biasing member and the cross-member 17, while still enabling a user to manually press the biasing member in direction A (as shown in 4) to enable the harmonica to be inserted between the biasing member and the cross-member 17.

Figure 9:
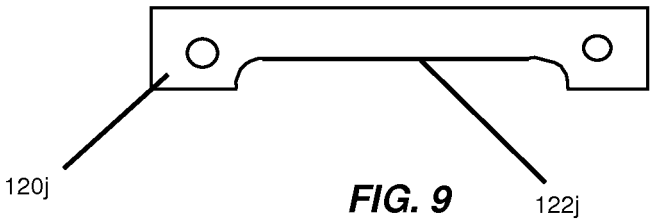
FIG. 9 is a plan view of alternative embodiment of the biasing member.

Referring to FIG. 9, in a particular embodiment 120*j* of the biasing member, a recess 122*j* is formed in a side of the biasing member facing the lips of a user playing a harmonica secured in the securement mechanism. Recess 122*j* provides added clearance or space for the lips of the user, while the remainder of the biasing member still retains the harmonica in the securement mechanism.

Figure 4:
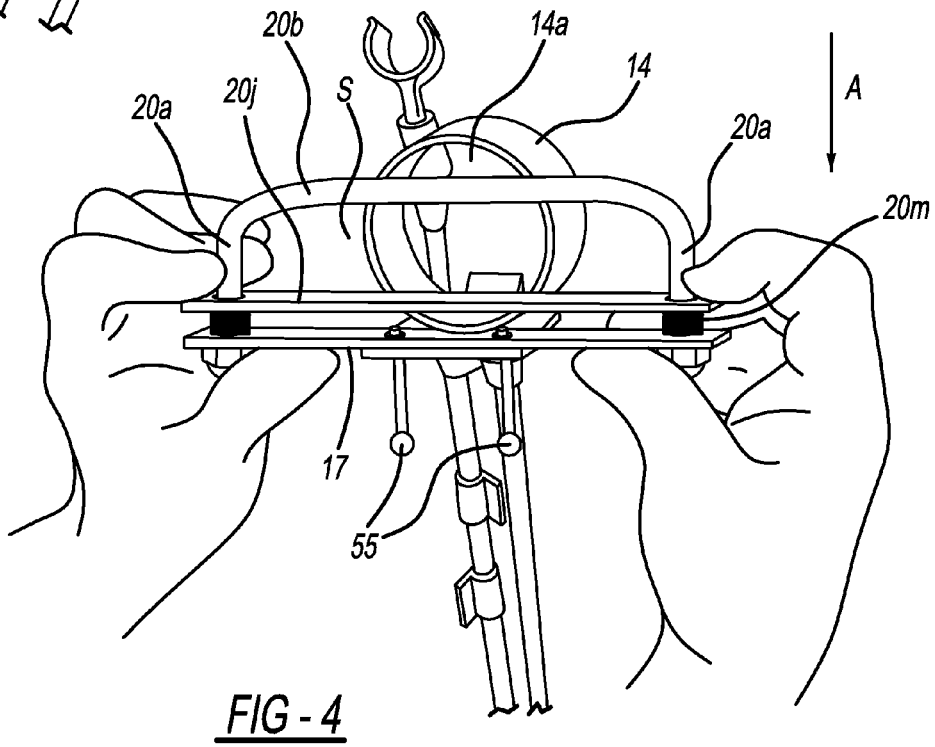
FIG. 4 is the view of FIG. 1 showing operation of a harmonica securement mechanism incorporated into the device.

Referring to FIG. 4, to secure a harmonica in the securement mechanism, biasing member 20*j* is pulled in the direction "A", thereby compressing springs 20*m* further and providing a space S suitable for insertion of the harmonica between the brace first portion 20*b* and the biasing member 20*j*. The harmonica 99 is then inserted into the space S and the biasing member 20*j* slowly released to engage the harmonica, whereby the instrument is secured between the first portion 20*b* and the biasing member 20*j*. The springs 20*m* are specified so that the forces exerted by the springs when compressed between the cross-member 17 and the biasing member 20*j* are sufficient to securely hold the harmonica in place while a user plays the instrument. Although coil springs are shown in the drawings, other types of spring members 20*m* may also be used.

The structure of the securement mechanism also enables some adjustment of the mounting position of the harmonica within the mechanism. That is, the final position of the harmonica in the securement mechanism when mounted may be adjusted so as to vary the distance of the harmonica from the microphone.

In another particular embodiment, the retainer is formed from a relatively rigid material (for example, a polymer) and is structured so that the microphone can be secured in a particular location within the retainer. In addition, the retainer and/or the securement mechanism 16 are adjustably positionable and securable on the base 12 with respect to each other (for example, using fasteners or other suitable means) such that a harmonica secured within the securement mechanism will abut an edge of the retainer closest to the securement mechanism responsive to a force pressing the harmonica toward the retainer, and before being forced out of the securement mechanism. This permits the position of the microphone relative to the harmonica to be adjusted within the retainer, while at the same time preventing the harmonica from being pushed out of the securement mechanism by a user. For example, the retainer and/or the securement mechanism may be secured on the base such that the end of the microphone is flush with an edge of the retainer closest to the securement mechanism, while permitting a harmonica secured in the mechanism to abut the edge of the retainer. In this manner, the retainer edge serves as a hard stop against which the harmonica is pushed while making contact with the microphone end residing flush with the retainer edge. Thus, contact between the harmonica and the microphone is conveniently maintained.

Brace 20 and biasing member 20*j* may be formed from a metallic material, a polymeric material, or any other suitable type of material.

In the embodiment shown, retainer 14 is generally circular and defines a cavity 14*a* structured to receive the microphone 90 therein. Retainer 14 may be shaped and sized to receive and secure therein a harmonica microphone having a predetermined size or diameter. Alternatively, the retainer may be structured so that a size or diameter of the microphone-receiving cavity defined by the retainer is adjustable. For example, the retainer 14 may be in the form of a ring with a gap formed therein to permit expansion of the ring to accommodate microphones of various sizes. The ends of the ring may be secured to each other using a bolt or other suitable means after the microphone has been positioned within the ring and the ends of the ring forced toward each other to securely grip the microphone within the ring.

In one embodiment, the retainer is formed from a polymeric or other electrically insulating material molded or formed into the desired shape. However, the retainer may be formed from any suitable material.

In a particular embodiment, metallic fasteners 24 positioned in holes 12*a* are used to secure the microphone retainer 14 to the base 12. However, any suitable method may be used to secure the retainer to base 12, depending on the materials from which the retainer and base are formed. Possible attachment methods include adhesives, ultrasonic welding, and any other suitable method.

Using any of the retainer embodiments described above, the position of the microphone 90 can be adjusted with respect to a harmonica 99 secured in the securement mechanism 16, to enable the microphone to be positioned and secured in contact with the harmonica.

The retainer 14 may be structured to provide clearance for user access to a microphone volume control located on the microphone body.

Figure 1A:
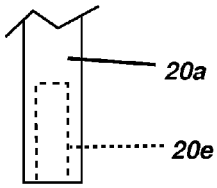
FIG. 1A is a side view of an end of an arm on a brace in accordance with an alternative embodiment described herein.
Figure 2:
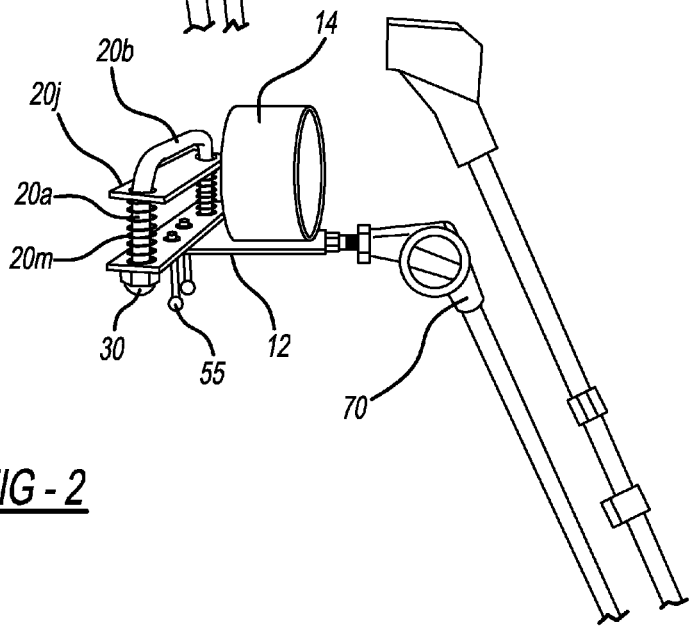
FIG. 2 is a side view of the device shown in FIG. 1.

In a particular embodiment, the microphone-receiving cavity 14*a* is cylindrical, and securement mechanism 16 and retainer 14 are positioned with respect to each other so as to align a central axis Z of the harmonica receiving space S with a central axis M of the microphone receiving cavity 14*a*, along a plane bisecting and lying perpendicular to a line extending along cross-member 17 and connecting central axes of arms 20*a* as shown in FIG. 1). This helps ensure alignment of the harmonica secured in the space S with a microphone secured in the cavity 14*a* during use.

In particular embodiments, the device 10 is structured such that a microphone 90 mounted in the retainer is electrically insulated from any metal used in fabricating the device. In one embodiment, a spacer (not shown) is configured to either encircle or wrap around a portion of a body of the microphone or otherwise be positioned between the microphone and the retainer, to space apart at least a portion of the microphone from the retainer when the microphone is mounted in the retainer. The spacer may be formed from an electrically insulating material which enables the spacer to be positioned along an exterior surface of the microphone, and also enables gripping, attaching, adhering, or otherwise securing the spacer in the desired position on the microphone. When the spacer is attached to the microphone, the spacer and microphone may be inserted into retainer cavity 14*a* and positioned such that the spacer is interposed between the microphone and the retainer.

In a particular embodiment, the spacer is configured so as to space the microphone apart from any metal used in construction of the device 10 when the microphone is secured in the retainer. This aids in interrupting any potential ground path for static charge from the microphone to ground.

In a particular embodiment, the spacer is positioned proximate a volume control knob (not shown) located along a lower surface of the microphone, to space apart the volume control knob from a surface of the retainer 14 against which the microphone rests, to provide further clearance between the volume control know and the retainer and permit easier access of the user to the knob.

The spacer may also be sized to occupy a portion of a space between the retainer and a microphone having an outer dimension which is too small to contact the retainer when position in cavity 14*a*. In this usage, the retainer takes up the "slack" between the retainer and the microphone, thereby enabling various different sizes of microphones to be secured in a retainer of having a single, fixed size of cavity 14*a*. To this end, the spacer may be formed from a resiliently deflectable insulating material (such as rubber or a foam material) structured to resiliently deflect to any of a relatively wide range of dimensions.

The spacer may also be structured so as to maximize static frictional forces between the spacer and the retainer and/or between the spacer and the microphone. This helps prevent movement of the microphone relative to the retainer, thereby aiding in maintaining the microphone in a desired position.

The spacer may be formed from any suitable electrically insulating material, such as a polymeric or rubber material. In a particular embodiment, the spacer is formed form a resiliently stretchable or deflectable material (such as rubber or neoprene) which is expandable to accommodate microphones of different sizes.

If desired, the spacer may be secured within and to retainer 14 after positioning therein, using any suitable method, such as adhesive application, etc.

As seen in the drawings, the base 12 of an embodiment of the support device may be securely affixed to a first angle adjusting boom (generally designated 70), which enables adjustable positioning and orientation of the base 12 with respect to a user. The first angle adjusting boom 70 adjusts the angle and position of the harmonica and harmonica microphone to accommodate the user's playing preference. The first angle adjusting boom pivots about a second height adjusting boom 72 that operates to adjust the height of the first angle adjusting boom 70 with respect to a horizontal ground surface (not shown).

The embodiments of the present invention described herein operate to simultaneously retain both a harmonica and a harmonica microphone in linear alignment while allowing a performer's hands free to play another instrument such as a guitar. As both the securement mechanism and the retainer are affixed to the base, the relative position of the securement mechanism with respect to the retainer does not vary.

When a harmonica is held in place in the securement mechanism, a user is free to play another instrument such as a guitar and to change instruments without having to worry about either manually holding the harmonica or wearing a cumbersome neck device to hold the harmonica.

As both the harmonica securement mechanism and the harmonica microphone retainer are each affixed to the first angle adjusting boom, the relative position of the harmonica securement mechanism with respect to the harmonica microphone retainer does not vary.

It will be understood that the foregoing descriptions of the various embodiments are for illustrative purposes only. As such, the various structural and operational features herein disclosed are susceptible to a number of modifications, none of which departs from the scope of the appended claims.

What is claimed is:

1. A device structured to support a harmonica and a microphone, the support device comprising:

a base;

a microphone retainer secured to the base; and a harmonica securement mechanism secured to the base adjacent the microphone retainer, the securement mechanism including a cross-member secured to the base, a biasing member coupled to the cross-member so as to be movable with respect to the cross-member, and at least one spring member positioned between the cross-member and the biasing member so as to urge the biasing member in a direction away from the cross-member.

2. The device of claim 1 wherein the securement mechanism further comprises a brace secured to the cross-member, the brace having a first portion including a first end, a second end spaced apart from the first end, and an arm extending in a first direction from each of the first end and the second end.

3. The device of claim 2 wherein the device is structured such that a harmonica is secured between the brace first portion and the biasing member when the harmonica is mounted in the securement mechanism.

4. The device of claim 1 wherein the base includes at least one longitudinal slot structured for receiving at least one fastener therein for securing the retainer to the base, the at least one longitudinal slot having a longitudinal axis structured to extend parallel to an axis oriented perpendicular to a longitudinal extent of a harmonica when the harmonica is mounted in the securement mechanism.

5. The device of claim 1 wherein the base is formed from an electrically insulative material.

6. The device of claim 1, wherein the device is structured such that a harmonica secured in the securement mechanism abuts the biasing member and the brace first portion.

7. The device of claim 2 wherein the end of each arm has a threaded cavity formed therein.

8. The device of claim 2 wherein the cross-member has holes formed therein, and wherein each hole is structured to receive therethrough a portion of a respective one of the brace arms.

9. The device of claim 1 wherein at least one of the retainer and the securement mechanism is adjustably positionable and securable to the base with respect to the other one of the retainer and the securement mechanism.

10. The device of claim 1 wherein the microphone retainer is formed separately from the base, and wherein the harmonica securement mechanism is formed separately from the base and the retainer.

11. The device of claim 2 wherein the at least one spring member is configured to be in compression when the biasing member is spaced apart a predetermined distance from cross-member, so as to consistently bias the biasing member in a direction toward the brace first portion.

12. The device of claim 1 wherein the retainer defines a microphone-receiving cavity therein, and wherein the retainer is structured so as to enable a dimension of the microphone-receiving cavity to be adjustable.

13. The device of claim 2 wherein the retainer defines a microphone-receiving cavity therein, and wherein the securement mechanism and retainer are positioned with respect to each other so as to align a central axis of the harmonica receiving cavity with a central axis of the microphone receiving cavity, along a plane bisecting and lying perpendicular to a line extending along cross-member and connecting central axes of the arms.

14. The device of claim 1 further comprising an electrically insulating spacer structured so as to be interposable between the microphone and the retainer when a microphone is secured by the retainer, to space the microphone apart from the retainer.

15. The device of claim 1 further comprising a recess formed in a side of the biasing member positioned to face lips of a user playing a harmonica secured in the securement mechanism.

16. A mechanism structured to support a harmonica and a microphone, the mechanism comprising:

a support device in accordance with claim 1; and a first angle adjusting boom structured to enable adjustable positioning and orientation of the base 12 with respect to a user.

17. A mechanism structured to support a harmonica and a microphone, the mechanism comprising:

a holder mountable on a body portion of a user; and a support device in accordance with claim 1 secured to the holder.

18. A device structured to maintain a desired spatial relationship between a harmonica and a microphone, the device comprising:

a base;

a microphone retainer secured to the base; and a harmonica securement mechanism secured to the base adjacent the microphone retainer, wherein at least one of the retainer and the securement mechanism is adjustably positionable and securable to the base with respect to the other one of the retainer and the securement mechanism.

* * * * *

UNITED STATES PATENT AND TRADEMARK OFFICE

CERTIFICATE OF CORRECTION

PATENT NO. : 8,993,864 B1
APPLICATION NO. : 14/054650
DATED : March 31, 2015
INVENTOR(S) : Cramer It is certified that error appears in the above-identified patent and that said Letters Patent is hereby corrected as shown below:

In the Specification

Column 1; Line 38; Please delete the second occurrence of "of the".

Column 2; Line 15; Please insert --be-- after may.

Column 6; Line 3; Please delete "form" and insert --from--.

Signed and Sealed this
Second Day of June, 2015

Michelle K. Lee

Michelle K. Lee
*Director of the United States Patent and Trademark Office*